US006135122A

United States Patent [19]

Campbell et al.

[11] Patent Number: 6,135,122

[45] Date of Patent: Oct. 24, 2000

[54] SELF ADHESIVE HAIR WEFT EXTENSION AND METHOD OF SECURING SAME

[76] Inventors: Annie L Campbell, 2133 22nd Ave. South; Will L. Nelson, 1748 21st St. South, both of St. Petersburg, Fla. 33712

[21] Appl. No.: 09/135,385

[22] Filed: Aug. 17, 1998

[51] Int. Cl.[7] ..... A41G 3/00

[52] U.S. Cl. ..... 132/201; 132/53

[58] Field of Search ..... 132/201, 53, 54, 132/55, 56

[56] References Cited

U.S. PATENT DOCUMENTS

| | | | |
|---|---|---|---|
| 2,835,259 | 5/1958 | Goodman | 132/53 |
| 2,862,509 | 12/1958 | Porte | 132/53 |
| 3,295,534 | 1/1967 | Dorkin | 132/201 |
| 3,307,562 | 3/1967 | Corbett et al. | 132/54 |
| 3,823,723 | 7/1974 | Miller | 132/201 |
| 3,900,038 | 8/1975 | Masters | 132/53 |
| 4,964,428 | 10/1990 | Lamatrice | 132/53 |
| 5,413,124 | 5/1995 | Incando | 132/201 |
| 5,575,298 | 11/1996 | Hinton | 132/201 |

FOREIGN PATENT DOCUMENTS

| | | | |
|---|---|---|---|
| 1301835 | 7/1962 | France | 132/201 |

*Primary Examiner*—Todd E. Manahan
*Attorney, Agent, or Firm*—Pendorf & Cutliff

[57] ABSTRACT

A self adhesive hair weft extension and method of securing same includes a hair weft that is formed by interweaving hair with fibers to form a weave end. The hair weft has a free end spaced from the weave end. Stitching is applied to the weave end. A bonding composition is applied to the first side of the weave end and forms a longitudinal strip of contact adhesive. A release strip covers the longitudinal strip of contact adhesive adhered to the first side of the weave end. The release strip is removable from the longitudinal strip of contact adhesive for allowing the weft to be attached to a section of natural hair on a head of an individual.

5 Claims, 3 Drawing Sheets

FIG 1
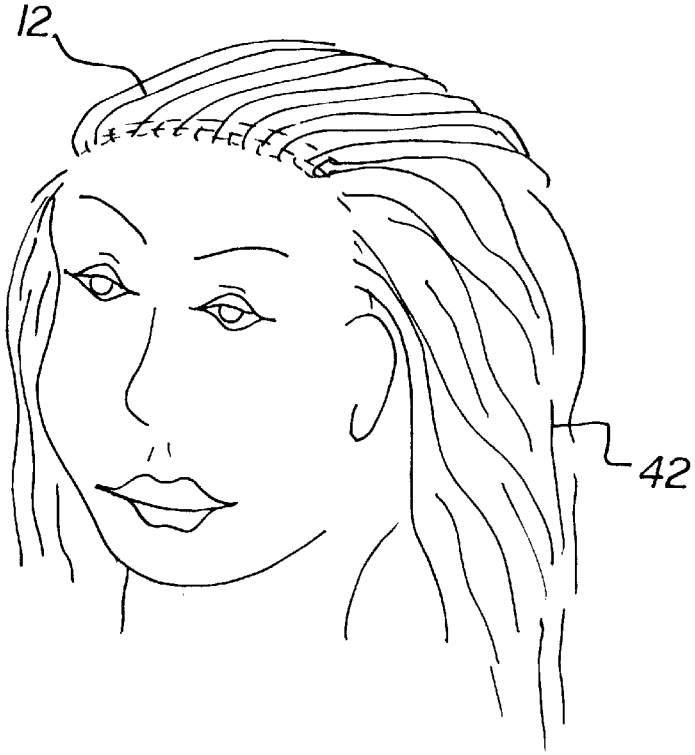
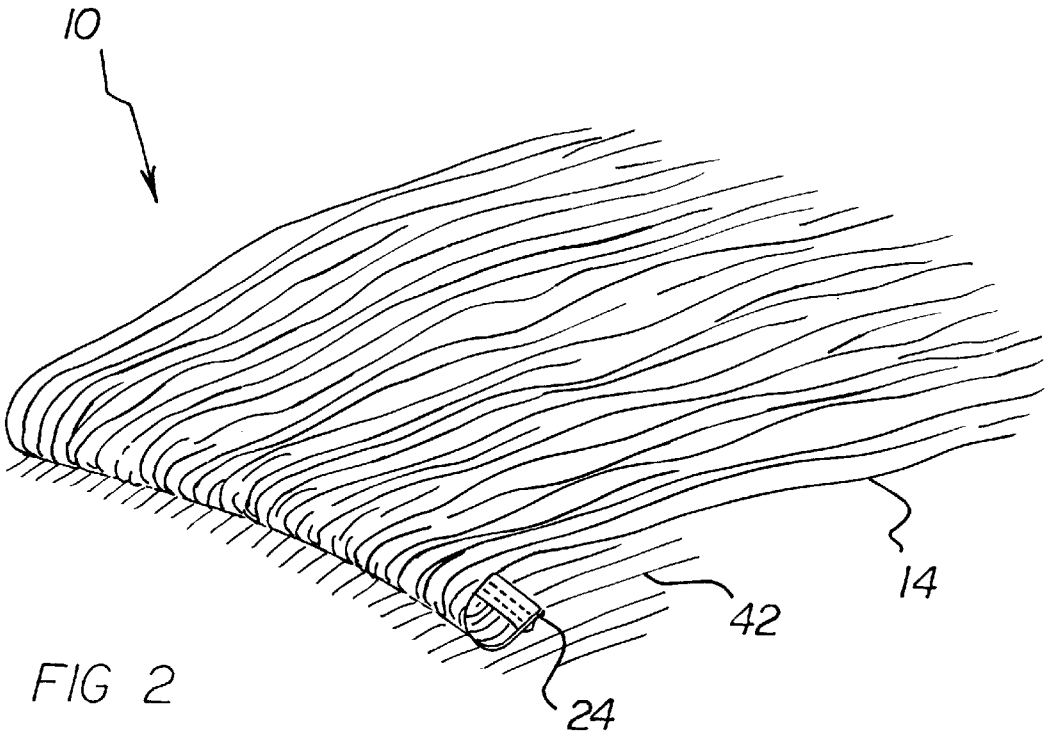
FIG 2

FIG 3
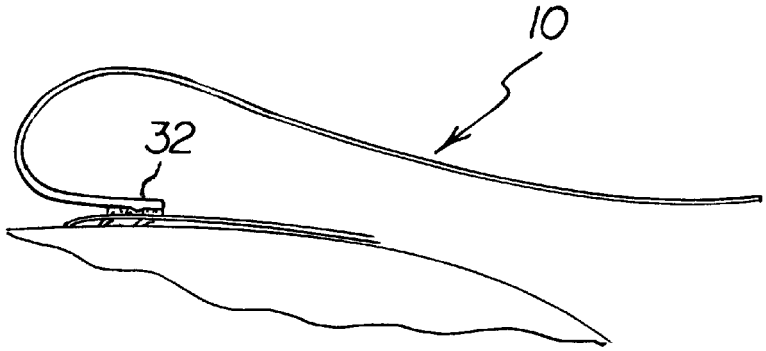
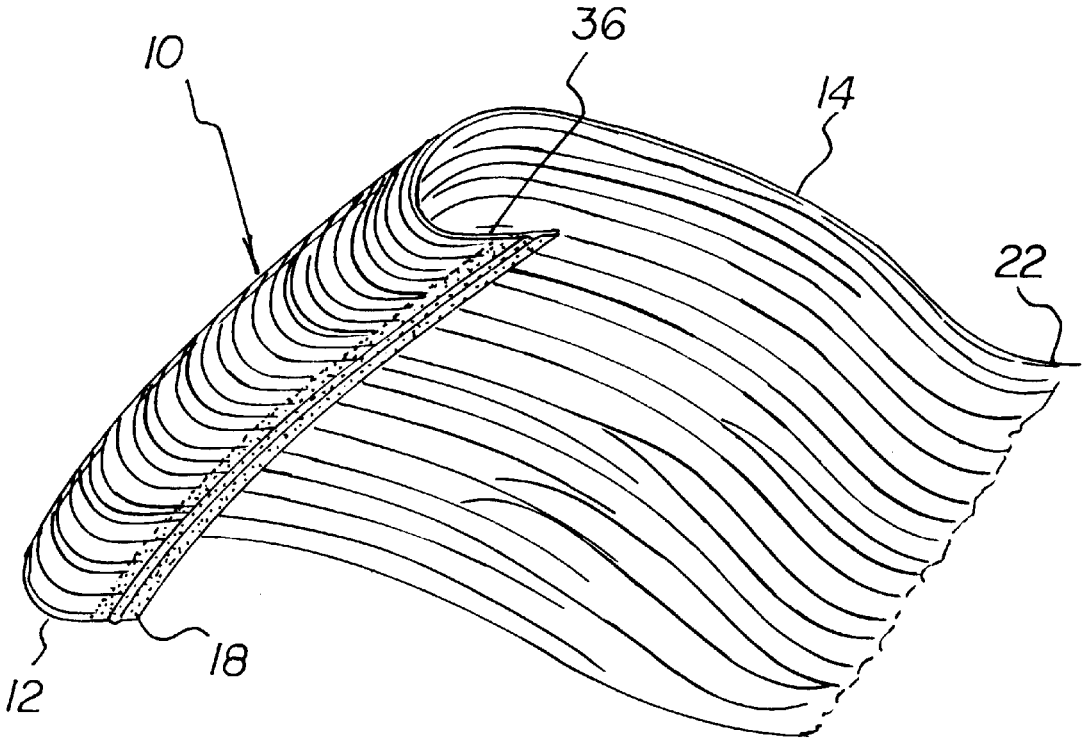
FIG 4

SELF ADHESIVE HAIR WEFT EXTENSION AND METHOD OF SECURING SAME

BACKGROUND OF THE INVENTION

1. Field of the Invention

The present invention relates to a self adhesive hair weft extension and method of securing same and more particularly pertains to providing a hair weft with a pre-application of a bonding agent and the pre-applied bonding agent allowing for ready adhesion of the hair weft to natural hair for extending the length of the natural hair and enhancing the fullness of the hair on a person's head.

2. Description of the Prior Art

The use of hair wefts to extend the length of natural hair is known in the prior art. More specifically, hair wefts heretofore devised and utilized for the purpose of extending natural hair are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,740,819 to Hicks discloses a process for securing supplemental hair to the natural hair of an individual. Specifically the invention forms a bound weft of supplemental hair and then utilizes a combination of braiding and sewing to secure the bound weft of supplemental hair to a person natural hair. Unlike the present invention Hicks uses a method that includes stitching the weft to the natural hair.

U.S. Pat. No. 5,413,124 to Incando discloses a hair weft and extension method and article. Incando is concerned with the manufacturing of a press hair weft that includes a vinyl composition pre-applied to an attached end of the individual hairs. The pre-applied vinyl composition is air dried and used to secure the individual hairs in the formation of the attached end. Incando requires a second application of a liquid bonding agent to adhere the hair weft to natural hair. The present invention requires a single application of a bonding agent during the formation of the weave end/attached end. The single application of the bonding agent is sufficient to hold the hair weft to the natural hair.

U.S. Pat. No. 2,862,509 to Porte discloses an ornamental eye piece with a pressure sensitive adhesive for attachment to eyelashes. The eye piece is made of a fine mesh material such as nylon.

The use of hair wefts, to enhance thin or short hair, are known in the art. Most hair wefts are formed my interweaving individual hair with a fiber material. Once the hair weft is formed it is adhered to natural hair by a sewing method or a bonding method. The sewing method requires the natural hair to be braided into sections. These sections may be longitudinal or vertical sections. The hair weft is measured to equal the length of the braid. Next a needle is threaded with a fiber material. The fiber material is sewn through the braid and the weave end of the hair weft. The sewing method is long and adds bulkiness to the hair mane.

The bonding method differs from the sewing method in that no braids are required. In the boding method the hair is parted into sections. The hair weft is measured to equal the length of the part. A liquid bonding agent is spread along the weave end of the hair weft. Once the bonding agent is on the hair weft the hair weft is attached to a section of the hair adjacent the part. The hair weft section must be held in place until it dries. In many instances the liquid bonding agent runs and drips on other sections of the natural hair or hair weft.

In this respect, the self adhesive hair weft extension and method of securing same according to the present invention substantially departs from the conventional concepts and designs of the prior art, and in so doing provides an apparatus primarily developed for the purpose of providing a hair weft with a pre-application of a bonding agent and the pre-applied bonding agent allowing for ready adhesion of the hair weft to natural hair for extending the length of the natural hair on a person's head.

Therefore, it can be appreciated that there exists a continuing need for a new and improved self adhesive hair weft extension and method of securing same which can be used for providing a hair weft with a pre-application of a bonding agent and the pre-applied bonding agent allowing for ready adhesion of the hair weft to natural hair for extending the length of the natural hair on a person's head, and enhancing the thickness and fullness of the mane. In this regard, the present invention substantially fulfills this need.

SUMMARY OF THE INVENTION

Accordingly, a primary of the self adhesive hair weft extension and method of securing same is to provide a hair weft with a pre-application of a bonding agent and the pre-applied bonding agent allowing for ready adhesion of the hair weft to natural hair. As such, the general purpose of the present invention, will be described subsequently in greater detail.

To attain this, the present invention essentially comprises a hair weft that has hairs interwoven with fibers to form a weave end. The hair weft has a free end spaced from the weave end. The fibers of the weave end entrain the hairs and support the hair. A stitching is applied to the weave end and creates a first side and a second side. Included is a bonding composition being applied to the first side of the weave end and forming a longitudinal strip of contact adhesive. The longitudinal strip of contact adhesive has a tacky side. The tacky side is pressure sensitive. Lastly, a plastic release strip is provided. The plastic release strip is sized to cover the longitudinal strip of contact adhesive adhered to the first side of the weave end. The plastic release strip is removable from the tacky side of the longitudinal strip of contact adhesive. The plastic release strip, once removed, allows the hair weft to be attached to a section of natural hair on a head of an individual.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved self adhesive hair weft extension and method of securing same, which has all the advantages of the prior art hair wefts and none of the disadvantages.

Another object of the present invention is to provide a self adhesive hair weft, which may be readily and easily adhered to the natural hair of a person.

A further object of the present invention is to provide a new and improved self adhesive hair weft extension that eliminates the number of steps required to adhered hair wefts to natural hair.

An even further object of the present invention is to provide a method of manufacturing a self adhesive hair weft extension which is susceptible of a low cost of manufacture with regard to both materials and labor, and which accordingly is then susceptible of low prices of sale to the consuming public, thereby making such self adhesive hair weft extension economically available to the buying public.

Still yet another object of the present invention is to provide a new and improved self adhesive hair weft extension which eliminates the mess created by the running and dripping of conventional liquid bonding agents.

Still another object of the present invention is to provide a longitudinal strip of contact adhesive that remains flexible when adhered to weave end of the hair weft.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the self adhesive hair weft in an operable orientation and constructed in accordance with the principles of the present invention.

FIG. 2 is a cut-away view of the present invention in an operable orientation.

FIG. 3 is a side view of the present invention as it appears when attached to the natural hair.

FIG. 4 is a bottom view of the presentation in an operable orientation

Similar reference characters refer to similar parts throughout the several views of the drawings.

DESCRIPTION OF THE PREFERRED EMBODIMENT

Figure 5:
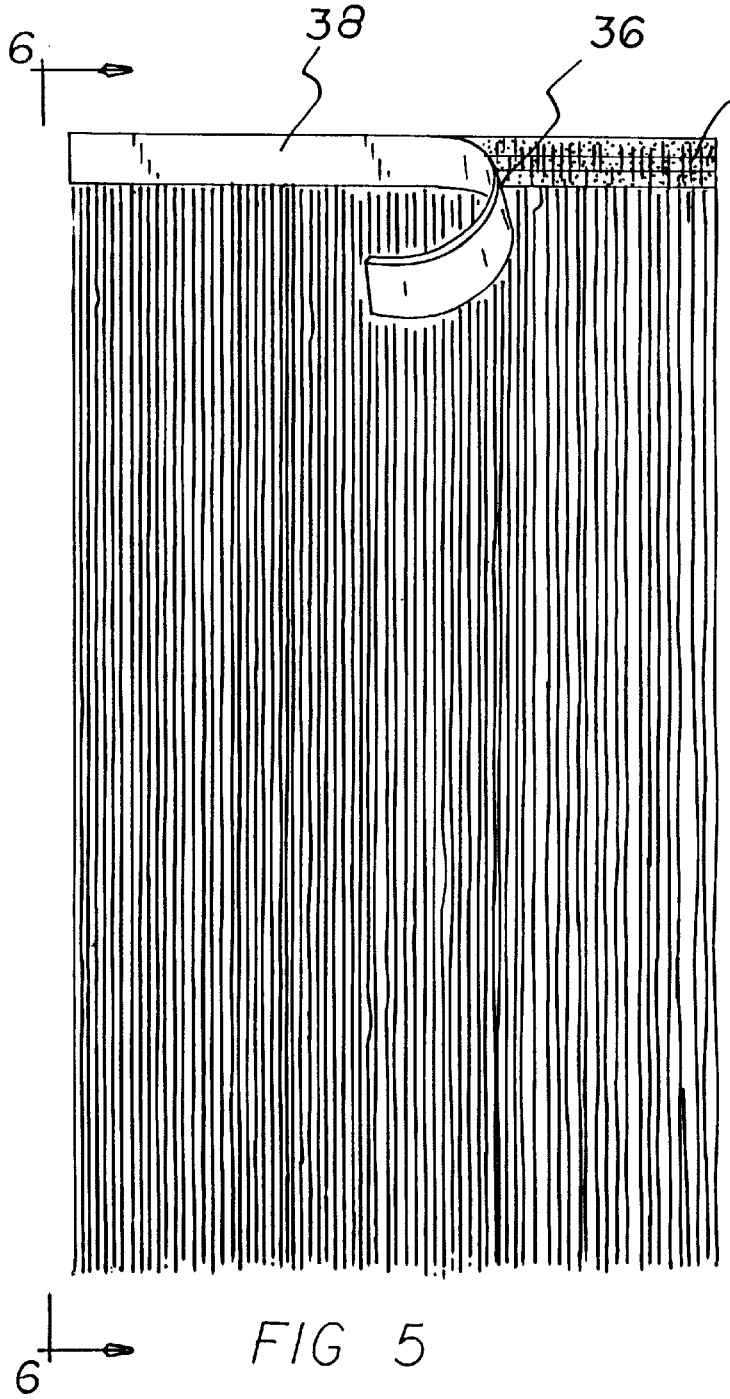
FIG. 5 is a frontal view of the hair weft as the plastic release strip is being removed.

With reference now to the drawings, and in particular to FIG. 1 thereof, a self adhesive hair weft extension and method of securing same embodying the principles and concepts of the present invention and generally designated by the reference numeral 10 will be described.

The present invention, the new and improved self adhesive hair weft extension, is comprised of a plurality of components. Such components in their broadest context include interwoven hair and fiber, bonding composition, and release strip. Such components are individually configured and correlated with respect to each other so as to attain the desired objective.

Figure 6:
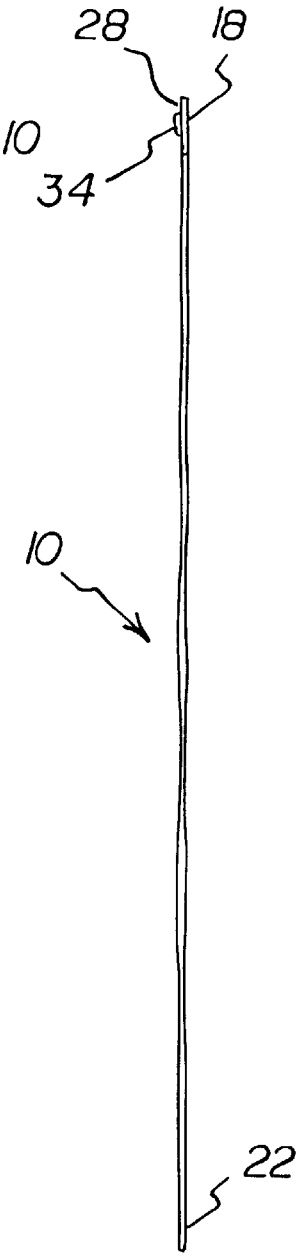
FIG. 6 is side view of the taken along 6—6 of FIG. 5.

More specifically, the present invention includes a hair weft 12 as shown in the FIGS. 1–6. The hair weft has a plurality of individual hairs 14 interwoven with fibers 16 to form a weave end 18. The hair weft has a free end 22 spaced from the weave end, as seen in FIG. 6. The fibers of the weave end entrain the hairs and support the hair therein. A stitching 24 is applied to ensure the tightness of the interwoven hair and fiber. The application of the stitching to the weave end creates a first side 28 and a second side 32. The first side has a raised portion 34, which is shown in FIG. 6. The hair used to produce the weft may be synthetic hair or natural hair or any other hair product in conventional use today. The material used with the fiber and the stitching is a thread. The thread may be the same for both the fiber and the stitching or, the thread used may vary in weight and thickness. As in conventional weaves the hair weft relies on the tightness of the interwoven fibers and friction between the individual fibers and the hair to prevent the hairs from translating out of the weave end. The fiber is thicker than the weave and the stitching is thicker than the weave.

Also, a bonding composition 36 or bonding agent is provided. The bonding composition, as shown in FIGS. 5 and 4, is a polyvinyl chloride, which is a liquid when first applied but hardens as a slow rate so as to retain its moisture until use. The bonding composition is applied to the first side 28 of the weave end and forms a longitudinal strip of contact adhesive 36. The longitudinal strip of contact adhesive is tacky. The longitudinal strip of contact adhesive is pressure sensitive. The raised portion 34 allows aggressive adhesion of the bonding composition to the weave end 18 of the hair weft.

To keep the longitudinal strip moist until time for use a release strip is provided. The release strip is plastic but, may be paper with a plastic coating. The release strip is sized for covering the longitudinal strip of contact adhesive 36 that is adhered to the first side of the weave end, as shown in FIG. 5. The plastic release strip is removable from the tacky surface of the longitudinal strip of contact adhesive and allows the weft to be attached to a section of natural hair 42 on a head of an individual. The bonding composition remains moist under the plastic release strip. The bonding composition of polyvinyl chloride dries to a solid form with removal of the plastic release strip and exposure to air. Furthermore, the dried from of the polyvinyl chloride remaining elastic.

Interweaving the individual hairs with fibers forms the self adhesive hair weft extension. The interweaving of the hair and fibers form the weave end. Once the weave end is formed an additional stitching is provided. The additional stitching to the interwoven hairs and fibers is performed along a linear path for tightening the woven hair and fibers of the weave end. The stitching allows for the creation of a first side and a second side at the weave end. The first side has a raised portion.

The newly formed hair weft extension has an application of a bead of bonding composition placed onto the first side of the weave end. Application of the bonding composition forms a longitudinal strip of contact adhesive 36, wherein the raised portion of the first side allows for aggressive adhesion between bonding composition and the weave end.

To keep the bonding composition moist during storage and until time for use, a release strip is placed on top. The release strip is plastic and is placed over the longitudinal strip of contact adhesive. When the hair weft is removed from storage or its container the release strip has remained in position. When the user is ready to apply the hair weft to the natural hair of a person the release strip is easily removed and exposed as shown in FIG. 5.

Furthermore, the user is able to easily attach the self adhesive hair weft extension to the natural hair of a person, as shown in FIGS. 1 and 2. The hair is parted on a head of an individual. In those cases where front of the added to the front of the hair line the hair weft may be adhered and folded back. But, in those instances where the hair weft is added throughout the hair the weft is placed between an upper hair segment and a lower hair segment. Next, the hair weft is cut to the desired length and width. Before placement of the hair weft can occur, the plastic release strip is removed from the longitudinal strip of contact adhesive adhered to a first side of the weave end.

The user touches the longitudinal strip of contact adhesive to check for tackiness or moisture retention. If the longitudinal strip of contact adhesive is tacky it is placed adjacent the lower hair segment, adjacent the part, and about one-fourth inches away from the scalp. Pressure is then applied to the second side of the weave end to ensure adhesion of the longitudinal strip of contact adhesive to the natural hair. For the addition of a plurality of hair wefts, the above steps are repeated for the other areas of the head of the individual.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, equitably entitled.

What is claimed is:

1. A self adhesive hair weft extension for securing to natural hair comprising:

a hair weft having hairs interwoven with fibers to form a weave end, the hair weft having a free end spaced from the weave end, the fibers of the weave end entraining the hairs and supporting the hair therein, a stitching being applied to the weave end creating a first side and a second side;

a bonding composition being applied to the first side of the weave end and forming a longitudinal strip of contact adhesive along a raised portion of the first side, the longitudinal strip of contact adhesive having a tacky side, the tacky side being pressure sensitive; and a release strip being sized for covering the longitudinal strip of contact adhesive adhered to the first side of the weave end, the release strip holds in the moisture of the bonding composition on the first side of the hair weft, the release strip removable from the tacky side of the longitudinal strip of contact adhesive for allowing the weft to be attached to a section of natural hair on a head of an individual.

2. The self adhesive hair weft extension as set forth in claim 1, wherein the raised portion allows aggressive adhesion of the bonding composition to the weave end of the hair weft.

3. The self adhesive hair weft extension as set forth in claim 1, wherein the bonding composition being a polyvinyl chloride that remains moist under the release strip.

4. The self adhesive hair weft extension as set forth in claim 3, wherein the polyvinyl chloride dries to a solid form with removal of the release strip and exposure to air, and the dried from of the polyvinyl chloride remaining elastic.

5. A method for attaching a self adhesive hair weft extension to natural hair of a person, the hair weft having a plurality of individual hairs having a weave end and a free end opposite the weave end, the weave end being bound together with interwoven fibers and stitching, the weave end having a first side and a second side with a bonding composition being incorporated with the first side, the bonding composition forming a longitudinal contact adhesive that is protected with a release strip until the user is ready to apply the hair weft extension, the attaching method including the steps of:

parting the natural hair on a head of an individual between an upper hair segment and a lower hair segment;

cutting the hair weft to the desired length and width;

removing a release strip from a longitudinal strip of contact adhesive adhered to a first side of the weave end;

touching the longitudinal strip of contact adhesive to check for tackiness;

placing the longitudinal strip of contact adhesive of the first side of the weave end adjacent the lower hair segment and adjacent the part;

applying pressure to the second side of the weave end to ensure adhesion of the longitudinal strip of contact adhesive to the natural hair; and repeating the steps for other areas of the head of the individual.

* * * * *